United States Patent [19]

Testone

[11] 4,454,621

[45] Jun. 19, 1984

[54] SHEET AND WEB CLEANER

[75] Inventor: Anthony Q. Testone, West Stockbridge, Mass.

[73] Assignee: Static Inc., Skippack, Pa.

[21] Appl. No.: 339,476

[22] Filed: Jan. 15, 1982

[51] Int. Cl.[3] ..... B08B 5/02; B08B 5/04

[52] U.S. Cl. ..... 15/1.5 R; 15/306 A; 15/307; 15/345; 15/415 A

[58] Field of Search ..... 15/1.5 R, 306 A, 306 R, 15/307, 308, 316 R, 345, 346, 415 A

[56] References Cited

U.S. PATENT DOCUMENTS

| | | | |
|---|---|---|---|
| 1,658,485 | 2/1928 | Hayward . | |
| 1,789,132 | 1/1931 | Birch | 15/307 |
| 2,818,595 | 1/1958 | Rosewall | 15/415 A X |
| 3,045,273 | 7/1962 | Bruno . | |
| 3,191,210 | 6/1965 | Fischer | 15/307 |
| 3,231,165 | 1/1966 | Wallin et al. | 15/345 X |
| 3,239,863 | 3/1966 | Gardner . | |
| 3,395,042 | 7/1968 | Herbert, Jr. . | |
| 3,775,806 | 12/1973 | Olbrant et al. | 15/345 X |
| 3,794,839 | 2/1974 | Hayne . | |
| 3,986,223 | 10/1976 | Kiefer . | |
| 4,198,061 | 4/1980 | Dunn . | |
| 4,241,377 | 12/1980 | Cumming | 15/1.5 R X |

OTHER PUBLICATIONS

Static Inc.-Autostat-Sheet and Web Cleaner-1974.

*Primary Examiner*—Chris K. Moore
*Attorney, Agent, or Firm*—Irvin A. Lavine

[57] ABSTRACT

Apparatus for cleaning a sheet or web while it is being fed. Upper and lower ionized air cleaner units are provided, having spaced, parallel plates providing a throat between which the sheet or web is passed. The throat entry includes diverging flanges, as does the throat exit. Each unit includes first and second spaced rows of ionized air blower holes extending transversely of the sheet or web; between these rows is an air suction slot. The ionized air generator includes a pair of spaced channel, each having its open side closed by a plate having the blower holes therein. An ionized air generator with air boost extends axially within each channel, and has ionizing points extending into the blower holes in the plate. The suction slot is provided between the two channels.

A linearly extending hood overlies the suction slot, having at an end thereof a suction outlet. The hood has a longitudinally extending entry slot which opens in width, being narrower at the end with the suction outlet; the hood tapers, having a larger cross section at the suction outlet end.

27 Claims, 7 Drawing Figures

50
10
2
S
13
14
11
2
12

52
57
13
55
4
5
51
53
54
56
16
39
18
17
39
16
14
37
37
21
20
27
27
20
22
28
24
26
21
31c
23
31
31a
31b
31
S
19
38
41
5
12
4

20
22
21
23
27
26
24
33
32
30
31c
36
27a
24a
38
34
38a
23a
S 11
13
14
7
7
42a
41a
6
6
30
27
27a
S
39
37
20
41
42

13
14
26
20
32
38
38a
23
22
33
33
39
37

SHEET AND WEB CLEANER

TECHNICAL FIELD

The present invention relates to an apparatus for cleaning a running length of a sheet or web of flaccid material by blowing ionized air against the sheet or web, and removing statically neutralized particles by suction.

BACKGROUND ART

It is common practice in a number of industries to move or feed a sheet or web of flaccid material along a path. This occurs in the textile and paper industries, as well as in various cleaning operations. It is known that particles of lint, dust, etc. are attracted to the sheet or web by static electricity, and there have been provided in the past various apparatus for cleaning sheets or webs by directing a stream of air, ionized or not, at the sheet or web, and then exhausting air from the vicinity of the sheet or web, there being entrained in the air which is exhausted from the sheet or web particles which have been loosened.

A previous sheet and web cleaner of the static neutralizing type has been produced in which a pair of air boost-type ion generating bars were placed in spaced, parallel relationship, within a housing, and the spacing between the ion generating bars defined a suction slot; the suction outlet was at the top of the housing, remote from the downwardly facing ion generating bars and suction slot, and thereby a relatively great distance was required between the path of the sheet or web and the suction outlet of the housing. Further, the construction and assembly of the ion generating bars was somewhat complex, in association with the housing or hood in which they were placed.

Among the prior art patents of interest to the present subject matter are Gardner U.S. Pat. No. 3,239,863, which discloses a web cleaning apparatus utilizing a pair of air blast nozzles extending transversely of the web, and having a suction area or nozzle between them. Also of note is Herbert, Jr. U.S. Pat. No. 3,395,042, which utilizes an ion generator extending transversely over the web, a pair of brushes, and a suction nozzle located between the brushes. Bruno, U.S. Pat. No. 3,045,273 provides a throat construction in which a web of paper or the like is cleaned, the throat containing both a blowing nozzle and a suction nozzle in close proximity, there being one set of nozzles on top of the web and a second set on the bottom of the web. Dunn U.S. Pat. No. 4,198,061 discloses a record cleaning apparatus, for cleaning a disk sound record, in which a pair of ion generators are provided in a head, on either side of a suction slot, there being provided, outwardly of the ion generators, a pair of blower nozzles, transverse of the record, comprised of a row of blower holes or air outlets; the suction slot is connected by a cavity having inclined top surfaces lower at their outer ends and higher at their inner ends, leading to a central cavity portion connected by a conduit extending parallel to the plane of the sound disk record, and to a side suction outlet connection. In this construction, baffles are provided to give an even distribution of air.

DISCLOSURE OF THE INVENTION

The present invention is directed to an improved sheet and web cleaning apparatus of the static neutralizing type. Ion generating bars of the air boost type are utilized, provided on either side of a suction slot. The suction slot is connected with a linearly extending hood having a suction outlet at one end thereof. The hood is of relatively low height, and is of generally pyramidal shape, with the suction outlet at the larger end. An inlet slot into the hood is provided, generally parallel to and spaced from the suction slot, the entry slot of the hood tapering in width, and having its narrower end adjacent the hood suction outlet end. This establishes uniform airflow across the suction slot.

The sheet and web cleaner includes a pair of cleaner units one on either side of the path of the sheet or web, the two cleaner units being substantially identical, each having air boost type ion generating bars in spaced apart relationship with a suction slot between them leading to a hood as above described, to thereby remove particles from both surfaces of the sheet or web. Because the air boost ion generating means discharges air against the surfaces of the sheet or web, the latter is thereby urged to float in the throat formed by the two cleaner units, which are typically placed so that one faces upwardly and the other faces downwardly, in opposed relationship to each other with the sheet or web between them. An entry into the throat is provided, to enhance the floating action of the sheet or web, and thereby encourage the avoidance of contact of the sheet or web with the cleaner apparatus, the construction providing diverging plates at the entry and exit of the throat.

The ion generating bars each comprises a channel in which is placed a tube, the tube having linear emitters with ionizing points extending therethrough; the ends of the legs of the channels are substantially closed by insulating plates having a row of blower holes in them, into and through which the ionizing points extend. The tubes of the ion generating bars are connected with a source of air under pressure, so that air which is ionized in the vinicity of the ionizing points is projected by the issuing air stream along the points and through the blower holes in the insulating plates, thereby to exit the ion generating apparatus and have the dual effect of floating the sheet or web and statically neutralizing the particles which may be thereon. The channels are held in spaced apart, parallel relationship by linear fasteners and spacers which extend through the legs of the channels, the spacing between the channels providing the suction slot. The two channels are supported in a housing, and the housing has a plate portion adjacent each of the insulating cover plates, and substantially coplanar therewith, so that a side of the throat for the sheet and web cleaner apparatus is provided by the cover plates and plate portions of the housing. This provides a compact, readily assembled construction.

BEST MODE FOR CARRYING OUT THE INVENTION

Figure 1:
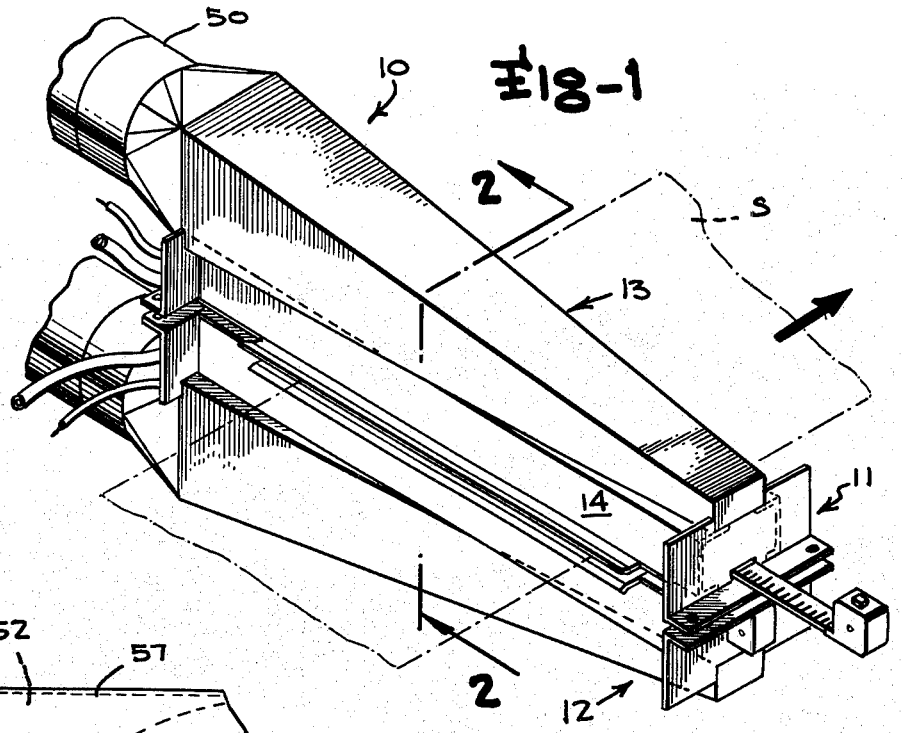
FIG. 1 is a perspective view of a sheet and web cleaner in accordance with the present invention.

Referring now to the drawings, wherein like or corresponding reference numerals are used to designate like or corresponding parts throughout the several views, there is shown in FIG. 1 a sheet or web cleaner 10 in accordance with the present invention, which includes an upper cleaner unit 11 and a lower cleaner unit 12 in opposed, spaced and facing relationship, a sheet or web S passing between them along a path. The path of the sheet or web S is generally horizontal, but this is not mandatory. The sheet or web may be of textile, paper, or other material, and is required to be cleaned, particularly of particles which are statically adhered to the sheet or web S. The upper cleaner unit 11 comprises a hood 13 and a housing 14 there below.

Figure 2:
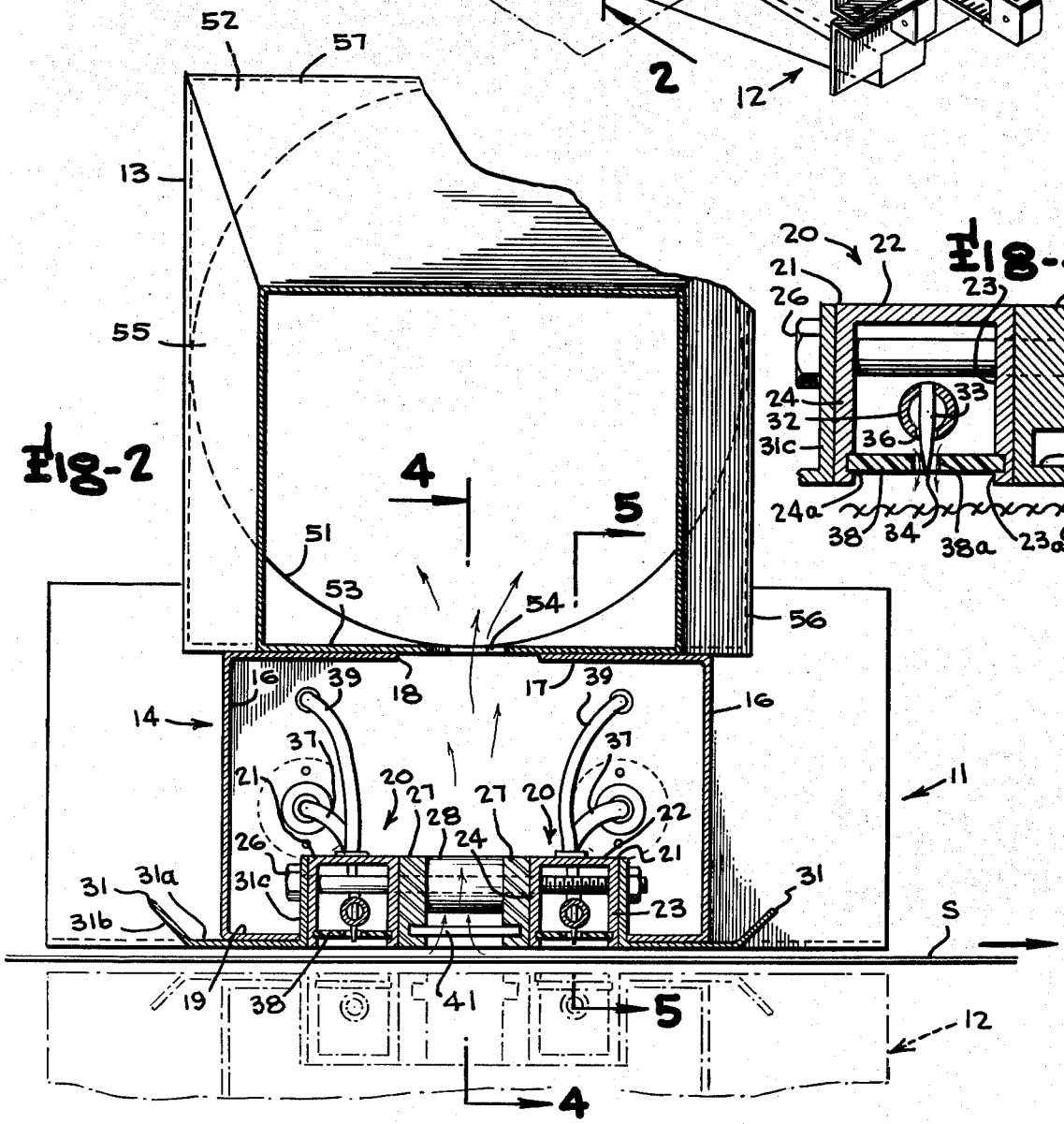
FIG. 2 is a cross-sectional view taken on the line 2—2 of FIG. 1, with parts broken away.

Reffering to FIG. 2, housing 14 will be seen to be of hollow, rectangular construction, having vertical side walls 16, a top wall 17 with a slot 18 therein, and a bottom wall 19.

Within the housing 14 there are provided a pair of substantially identical ion generators 20, each comprising a channel 21 having a web 22 and a pair of depending legs 23, 24. The ion generators 20 are secured by any suitable means to end walls of the housing 14, and are secured together as a unit in spaced apart, parallel relationship by bolts 26 having suitable spacers thereon, the bolts passing through a pair of spacer plates 27 and a spacer sleeve 28. Thus, between the channels 21, and more particularly between the spacer plates 27, there is provided a slot 30, which functions as a suction slot.

A throat plate 31 is provided, having a throat plate portion 31*a* underlying and engaging the housing bottom plate 19 and which functions as a part of the housing 14. A guide portion 31*b* extends upwardly from portion 31*a*, beyond the housing 14, and a connecting portion 31*c* is adjacent and in engagement with a leg of a channel 21. The fastening bolt 26 extends through the connecting portion 31*c*, so that the throat plate 31 is thereby connected to the ion generators 20. As clearly shown in FIG. 2, there is a throat plate 31 secured to each of the channels 21.

Figure 3:
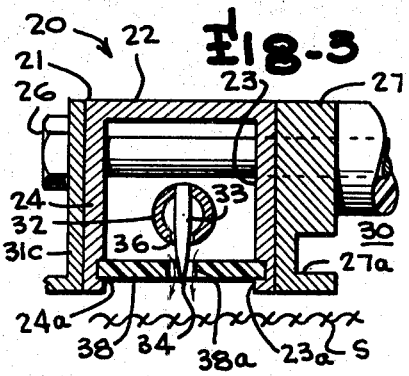
FIG. 3 is an enlarged cross-sectional view of a portion of the apparatus shown in FIG. 2.

Referring to FIG. 3, there may be seen the ion generator 20 in the form of a static bar which extends transversely of the path of the sheet S and which includes a channel 21 having a web 22 and legs 23 and 24. Extending axially within the channel 21 is a tube 32 which has a series of linear emitters 33 extending diametrically therethrough. The emitter 33 has an ionizing point 34, which is conical, as is a portion of emitter 33. Emitter 33 passes through one of a row of holes 36, which are larger than the portion of the emitter 33 which passes through the hole 36, thereby providing a passage surrounding the emitter 33. The tube 32 is provided with air under pressure from a source of compressed air, through air supply conduit 37 (see FIG. 2) so that air is discharged from the tube 32 in surrounding relationship to the emitter 33.

Each leg 23, 24 of channel 21 is provided, near its end remote from the web 22, with an inwardly facing slot 23*a*, 24*a*. A cover plate 38 of insulating material is held in the slots 23*a* and 24*a*, and is provided with a row of blower holes 38*a*. The emitter will be seen to extend into and through the blower hole 38*a* and being smaller in diameter than the blower hole 38*a*, there is thereby provided an annular passage for air which is discharged from the tube 32. This air, upon escaping beyond the ionizing points 34, is ionized, and is directed against the sheet or web S. Ionization occurs, in known fashion, due to the connection of the conducting tube 32 with a source of electricity, by the conductor 39 (FIG. 2).

The spacer plate 27 has therein a slot 27*a* which, like the spacer plate 27, extends transversely of the path of the sheet or web S. The slots 27*a* are provided for supporting a pair of slot width adjustment blades. Referring to FIG. 2, there will be seen the spacer plates 27, with the slots 27*a*, and a blade 41 carried therein. The blade is movable in the slots 27*a*.

The upper cleaner unit 11 and the lower cleaner unit 12, as shown in FIG. 2, are in spaced apart, facing relationship, the units being substantially mirror images of each other. Therefore, cleaner unit 12 is shown in phantom liner and details of cleaner unit 12 are omitted from FIG. 2, it being noted, however, that between them there is the path of the sheet or web S, which may move, for purposes of illustration, in the direction indicated by the arrow. The air discharged from the four rows of blower holes 38*a* in the four cover plates 38 will impinge against the sheet or web S and tend to float it, maintaining it substantially out of contact with the sheet and web cleaner 10. This action is enhanced by the guide portions 31*b* of the throat plates 31. The amount of air drawn into the suction slot 30 of each cleaner unit is greater than the amount of air supplied through the blower holes 38*a* of each cleaner unit, and therefore, air is drawn into the throat, both at the left end of the throat as viewed in FIG. 2, which is the entry portion for the sheet or web S, and at the right hand end thereof, which is the exit portion for the sheet or web S. The guide portions 31*a*, therefore, serve to guide equally the additional air which is drawn into the throat, so that equal amounts of air enter into the throat on either side of the sheet or web S. Also, they tend to reduce turbulence. The throat plates 31, of which there are two for each unit, may thereby be seen to be, in effect, portions of the housings to which they are attached, such as the housing 14. The throat of the apparatus 10 will be seen to be defined by the plate portions 31*a* of throat plate 31, forming part of the housing 14, and also by the cover plates 38.

The cover plates 38 serve to prevent the entry of debris into their channels, and also serve to provide a portion of the throat structure, which serves to confine the air, and to assist in the floating action of the sheet or web S. In addition, although the ionizing points 34 extend slightly beyond the cover plates 38, the cover plates 38 help to avoid contact of the sheet or web S with points 34, and thereby the damaging of the sheet or web S.

Figure 4:
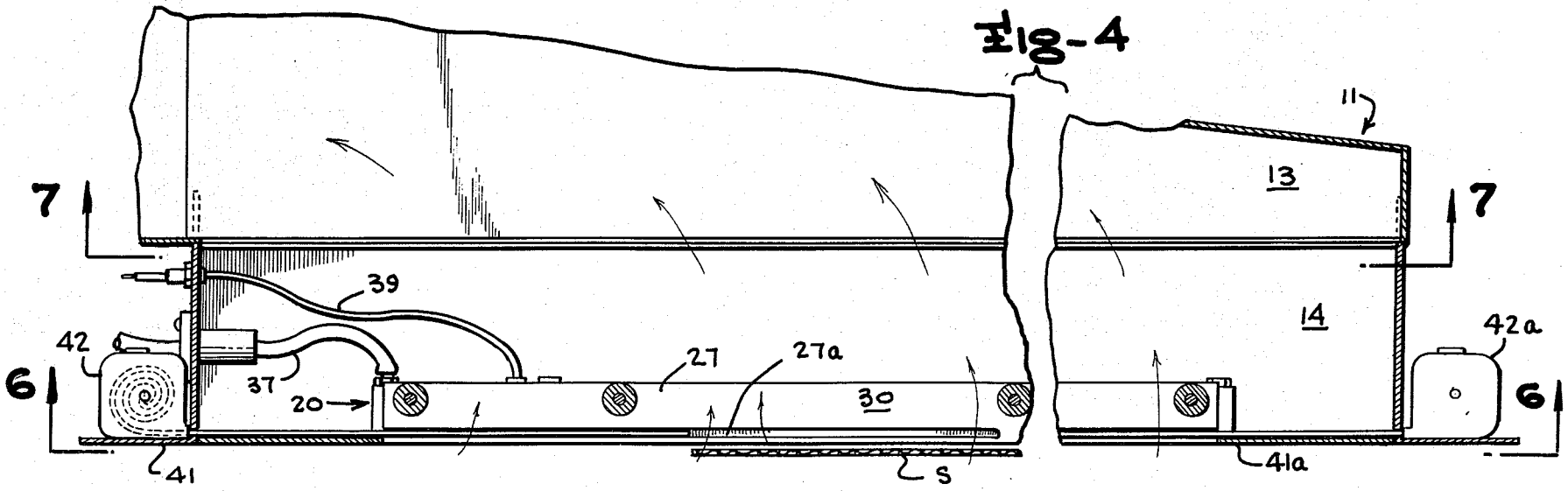
FIG. 4 is a cross-sectional view taken on the line 4—4 FIG. 2.

Referring now to FIG. 4, there may be seen a longitudinal cross-sectional view, with parts broken away, of the upper cleaner unit 11 wherein there may be seen the hood 13 having its long axis extending transversely of the path of the sheet or web S, and lying above the housing 14. There is shown one of the ion generators 20, with the spacer plate 27 thereadjacent, the latter including the groove 27*a*. The space plate 27 defines the boundaries of the suction slot 30, which is of generally rectangular shape. The width of the suction slot 30 may be adjusted, so as to be substantially the same as the width of the sheet or web S, by any suitable apparatus. There is illustrated in FIGS. 1 and 4 a slot width adjustment apparatus which includes a conventional steel measuring tape 42, which includes a blade 41 of spring steel, or the like, which may be coiled in the housing thereof and pulled therefrom, against a rewinding spring. The measuring tape 42 has a locking device, to lock the blade 41 in any desired extended position. The blade 41 rests in and is guided by the slots 27*a*, and as is illustrated in FIG. 4, there is a second such measuring tape 42*a*, having an extendible blade 41*a* which extends into and is supported by the slots 27*a* in the spacer plates 27. By knowing the length of housing 14 transversely of the path of the sheet or web S, and the width and position of a particular sheet or web S, the blades 41 and 41*a* may be caused to be extended a suitable distance out of the respective measuring tapes 42 and 42*a*, so that when those devices are positioned as shown in FIG. 4, there will be provided a slot 30 having a length which is substantially the same as and co-extensive with the width of the sheet or web S. Thus, there is provided an apparatus for adjusting the width and location of the suction slot 30. The apparatus herein disclosed is illustrative, the preferred apparatus utilizing, in addition to housings for the spring steel blades 41 and 41*a*, rollers intermediate the housings for the blades and the housing 14, there being a pair of rollers engaging each of the blades, one on either side. One roller serves as a backup roller, or pinch roller, and the other roller serves as a drive roller, it being understood that both rollers have frictional engagement with the blade. In this preferred organization, the drive roller has a shaft having a manually rotatable knob thereon, so that by rotating the knob the drive roller is caused to rotate, and since it has frictional engagement with the blade, which also is engaged, on its reverse side, by the pinch or backup roller, movement of the blade to and fro in the slots 27*a* may be effected as desired. In this preferred embodiment, a brake for the blade may not be necessary, nor a return spring. Further, the free end of each of the blades 41, 41*a* may be provided with a low-friction leading element, such as a nylon shoe or thimble.

Figure 5:
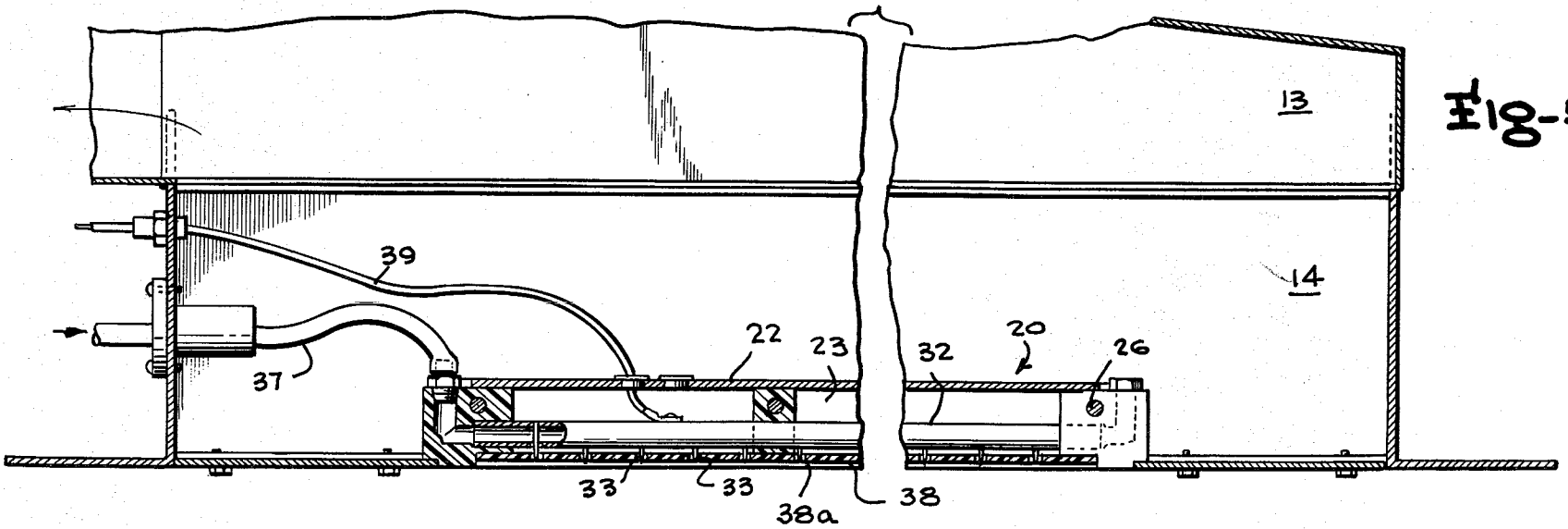
FIG. 5 is a cross-sectional view taken on the line 5—5 of FIG. 2.

Referring now to FIG. 5, there may be seen air supply conduit 37 and conductor 39, connected to the linearly extending ion generator 20, which extends transversely of the path of the sheet or web S, and to or beyond the lateral boundaries thereof. Tube 32 is shown within the channel 21, there being visible in FIG. 5 only the web 22 and leg 23 of channel 21. The air supply conduit 37 may be seen to be connected to the interior of the tube 32 and there may be seen the row of linear emitters 33 which extend from the tube 32 and pass through the blower holes 38*a* in the cover plate 38, which latter is of insulating material. There may also be seen in FIG. 5 the bolts 26.

Figure 6:
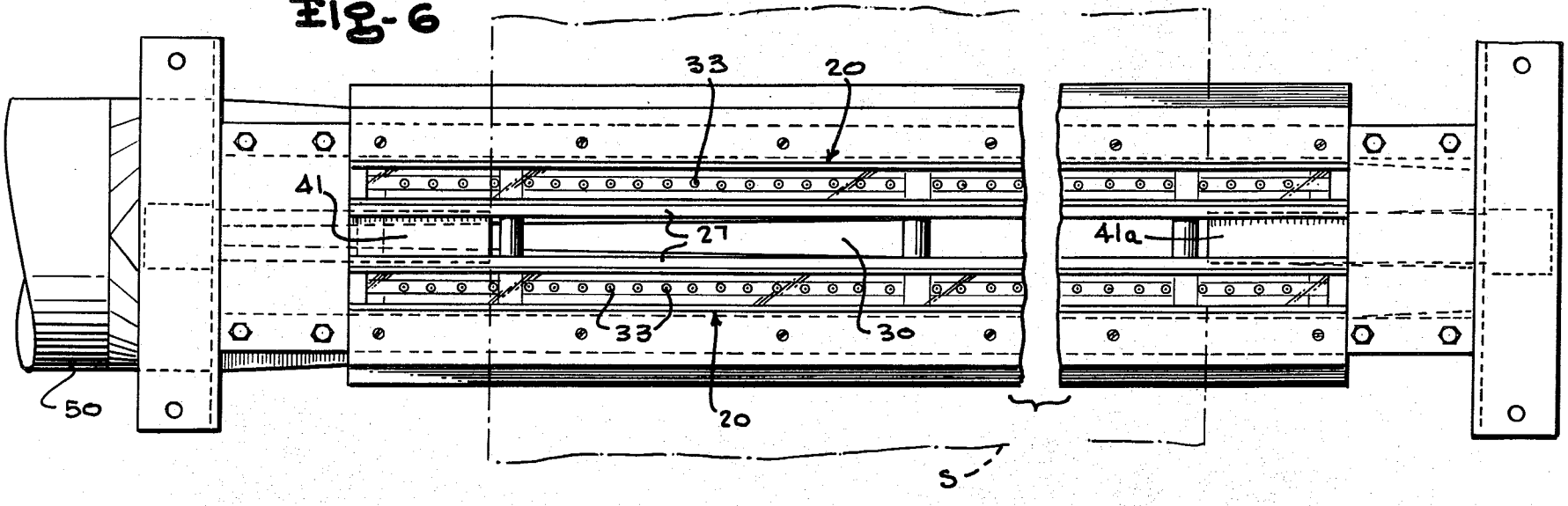
FIG. 6 is a view taken on the line 6—6 of FIG. 4, and looking in the direction of the arrows.

Referring now to FIG. 6, there may be seen the two spaced, parallel ion generators 20, including the rows of linear emitters 33, there being a single, straight row of such emitters forming a part of each ion generator 20. There may also be seen the suction slot 30 which is of rectangular configuration, being bounded by the two spacer plates 27 and by the ends of the blades 41 and 41*a*. As will be seen, the ends of the blades 41 and 41*a* are positioned approximately at the edges of the sheet or web S. Thus, ionized air from the air boost ion generators 20 will pass out of the blower holes 38*a* in a direction so as to strike against the sheet or web S, thereby statically neutralizing particles thereon, these particles then forming debris which is carried by the moving air stream, which air stream then enters the suction slot 30, being drawn thereinto by a suitable suction connection.

Figure 7:
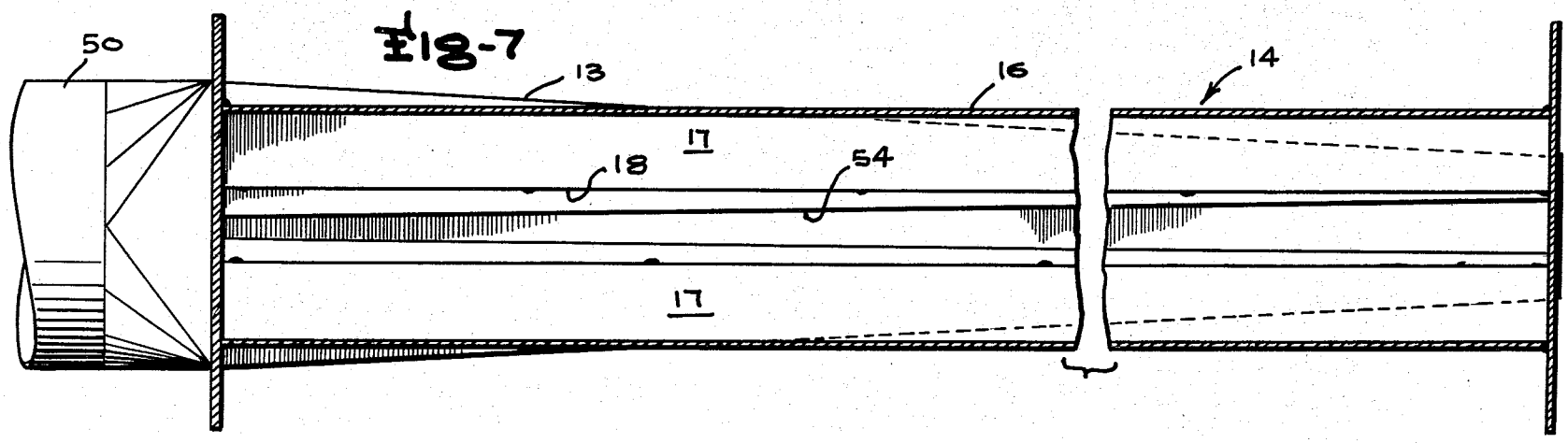
FIG. 7 is a cross-sectional view taken on the line 7—7 of FIG. 4.

Referring now to FIG. 1, there may be seen the pyramidal hood 13 extending above the housing 14, and having at its larger end a suction outlet to which is connected a suction conduit 50. As shown in FIG. 2, the suction outlet 51 is provided in the end wall 52 of pyramidal hood 13. In its bottom longitudinal wall 53, hood 13 is provided with a slot 54 which overlies the slot 18 in the wall 17 of housing 14. Referring now to FIG. 7, there may be seen the upper wall 17 of housing 14, having the slot 18 therein, slot 18 being seen to be substantially rectangular. Above slot 18 is the slot 54, which is the inlet slot into the hood 13. Slot 54 is tapering, having its wider end remote from the suction conduit 50 and its narrower end adjacent thereto. In addition, FIG. 7 shows that the hood 13 enlarges, from the end thereof remote from the suction conduit 50, to the end thereof which is adjacent the suction conduit 50. Referring again to FIG. 2, it will be seen that the walls 55 and 56 of hood 13 diverge from each other, and that the wall 57 diverges from the wall 53, so that the cross section of hood 13 enlarges from the smaller end to the larger end in both horizontal and vertical planes as shown in FIG. 2.

The above-noted construction of the slot 54 and of the pyramidal hood 13 results in an even air flow into the slot 30, across its entire length, or across its effective length, and thereby there is effected uniform cleaning and removing of debris from the travelling sheet or web S.

There has been provided a sheet and web cleaner of the ion generating type, having both air blowing and suction. The sheet or web is caused to pass through a throat, provided by opposed, substantially identical cleaner units of the above-described type, each unit having plates which define the throat, through which pass ionizing points. The air discharged by the cleaner units is directed against the opposite surfaces of the sheet or web, so that it tends to float within the throat, without engaging the parts of the equipment, and particularly without engaging the ionizing points, thereby avoiding damage to the sheet or web. The ion generators, of the air boost type, are constructed so that they both permit the discharge of ionized air, and, through the provision of a cover plate with a row of blower holes, substantially prevent the entry of debris into the ion generator, thereby avoiding clogging and malfunction of the ion generator over long periods of use. The herein disclosed sheet and web cleaner apparatus is provided with a hood having a lateral or side discharge, rather than a central, or upper discharge, so as to achieve low heighth of the apparatus, and particularly of the hood, and in association therewith, there are provided means for obtaining, even with the side discharge or suction, substantially uniform flow of air into the suction slot, and therefore substantially uniform cleaning of the sheet or web. The disclosed sheet and web cleaner has high efficiency in operation, while being compact and economical in construction.

I claim:

1. In apparatus for cleaning a running length of a sheet or web of flaccid material, (a) means defining a throat for the passage of a sheet or web of flaccid material therethrough comprising spaced, parallel plates, and having a throat entry and a throat exit, (b) means for supporting the sheet or web of flaccid material in the throat without substantial engagement therewith comprising means for blowing ionized air from each said plate toward the other plate to engage both sides of the sheet or web, (c) means for sucking air through each said plate, and (d) diverging guide plates at the throat entry extending from each said throat defining plate.

2. Apparatus according to claim 1, and further comprising a diverging guide plate at the throat exit extending from each said throat defining plate.

3. Apparatus according to claim 1 or 2, wherein said means for blowing air comprises means for ionizing the air, said air ionizing means including ionizing points extending through holes in said plate into said throat.

4. Apparatus according to claim 3, wherein said means for ionizing the air comprises a pair of air ionizing bars associated with each said plate and extending in spaced parallel relationship transversely of said throat, said means for sucking air through said plate comprising a suction slot between said spaced air ionizing bars.

5. Apparatus according to claim 4, wherein each said suction slot defines a substantially rectangular opening in each said plate.

6. Apparatus according to claim 1 or 5, and further comprising means for adjusting the length of said suction slot.

7. Apparatus according to claim 5, wherein said means for sucking air further comprises a linearly extending hood generally parallel to said air ionizing bars and fluid connected to said suction slot, said hood having a suction outlet at one end thereof, and means for providing substantially uniform airflow into said suction slot.

8. Apparatus according to claim 7, said last mentioned means comprising (a) means defining an entry slot in said hood for receiving air thereinto said entry slot tapering in width and having its narrower end adjacent the hood suction outlet, and (b) said hood uniformly linearly tapering in cross section and having the largest cross section at the suction outlet.

9. Apparatus according to claim 8, said means defining said entry slot being substantially parallel to said suction slot.

10. Apparatus according to claim 7, and further comprising means for adjusting the length of said suction slot.

11. Apparatus for cleaning a travelling sheet or web by sucking debris-laden air from adjacent the surface thereof comprising:

means defining a substantially rectangular suction slot extending transversely of the path of the sheet or web, a hood extending transversely of the path of the sheet or web and having ends adjacent the lateral boundaries of the said path, said hood having a suction outlet at one end thereof and being fluid connected to said suction slot, and means for providing substantially uniform airflow into said suction slot comprising:

(a) means defining an entry slot in said hood for receiving air thereinto, said entry slot tapering in width and having its narrower end adjacent the hood suction outlet, and (b) said hood uniformly linearly tapering in cross section and having the largest cross section at the suction outlet.

12. The apparatus of claim 11, said means defining an entry slot being substantially parallel to said suction slot.

13. Apparatus according to claim 11, said means defining said suction slot comprising a pair of spaced, parallel channels.

14. Apparatus according to claim 13, and further comprising a linearly extending ion generating means in each said channel for generating ionized air adjacent the path of the sheet or web.

15. Apparatus according to claim 11, and further comprising ion generating means extending transversely of the path of the sheet or web adjacent said suction slot.

16. Apparatus according to claim 11 or 15, and further comprising means for adjusting the length of said suction slot.

17. In apparatus for cleaning a running length of a sheet or web, an elongate housing having a wall with a linearly extending opening therein, a pair of spaced, parallel channels in said housing having their webs substantially coplanar and facing in the same direction and having their legs extending into said opening, linearly extending ion generating means in each said channel having a row of linear emitters parallel to the legs of said channels and having the ionizing points of said emitters remote from said web, means for discharging air from said ion generating means, and means for securing said channels together as a unit in said spaced, parallel relationship in said housing comprising linear fastener means extending through the legs of said channels, and at least one spacer cooperating with said linear fastener means and located between said channels.

18. The apparatus of claim 17, and further comprising cover plate means substantially closing said channels, said cover plate means having blower holes therethrough, said linear emitters each extending into a said blower hole, and a passage between said emitter and said blower hole, to enable air to pass adjacent each said emitter and through said blower hole.

19. The apparatus of claim 18, wherein the legs of each said channel have axially extending slots on the interior thereof remote from said channel webs, said cover plate means extending into and held by said slots in said channel legs.

20. The apparatus of claim 17, wherein said ion generating means comprises a tube extending axially in said channel, said linear emitters extending diametrically through said tubes.

21. The apparatus of claim 20, said tube having a row of holes therein, said linear emitters each passing through a said hole, the hole being larger than the emitter to thereby provide an air passage, and means for connecting said tube to a source of air under pressure.

22. Apparatus for cleaning a running length of a sheet or web of flaccid material by statically neutralizing particles thereon and for maintaining the sheet or web in a substantially planar path comprising:

(a) first and second ion generating means each including a row of linear emitters having ionizing points transverse of the path of the sheet or web and adjacent thereto, (b) a pair of substantially planar and generally imperforate plate means adjacent and parallel to the path of said sheet or web for confining air adjacent to the sheet or web, each said plate means having (i) a first portion interrupted substantially only by a row of blower holes, ionizing points of a said generating means extending into said blower holes and providing an air passage about each said ioinizing point, (ii) a second, substantially imperforate portion substantially coplanar with said first portion, and (c) means defining a suction slot between said rows of emitters extending transverse of said path and spaced along said path from said plate means, (d) said apparatus being free of means for physically engaging the sheet or web and further including third and fourth ion generating means and third and fourth plate means in opposed, facing relationship to said first and second ion generating means and to said first and second plate means, respectively, on the opposite side of said path therefrom, whereby said plate means confines air adjacent the sheet or web and assists in maintaining the sheet or web out of contact with said apparatus while moving at high speed along said path.

23. The apparatus of claim 22, and further comprising a housing, said ion generating means in said housing, said second imperforate portions of said plate means being parts of said housing, and said suction slot entering into said housing.

24. The apparatus of claim 23, and a linearly extending hood engaging said housing opposite said suction slot, a suction outlet at one end of said hood, and means for providing substantially uniform airflow into said suction slot.

25. The apparatus of claim 24, the last mentioned means comprising (a) means defining an inlet slot in said hood for receiving air therefrom, said inlet slot tapering in width and having its narrower end adjacent the hood suction outlet, and (b) said hood uniformly linearly tapering in cross section and having the largest cross section at the suction outlet.

26. The apparatus of claim 24, and further comprising means for adjusting the length of said suction slot.

27. The apparatus of claim 22, wherein said ionizing points extend through said plate means blower holes.

* * * * *